US006347614B1

(12) United States Patent
Evers et al.

(10) Patent No.: US 6,347,614 B1
(45) Date of Patent: Feb. 19, 2002

(54) MECHANICAL FUEL INJECTION SYSTEM

(76) Inventors: Lawrence W. Evers, HC1 - Box 977D, Lake Linden, MI (US) 49945; William J. Towne, N5305 Merrill Rd., Rosendale, WI (US) 54974; Jeremy S. Carlson, 7454 S. Lake Bluff 0.5 Dr., Gladstone, MI (US) 49837

( * ) Notice: Subject to any disclaimer, the term of this patent is extended or adjusted under 35 U.S.C. 154(b) by 0 days.

(21) Appl. No.: 09/567,462

(22) Filed: May 9, 2000

Related U.S. Application Data

(63) Continuation-in-part of application No. 09/360,077, filed on Jul. 23, 1999.

(51) Int. Cl.[7] ..... F02M 7/00
(52) U.S. Cl. ..... 123/446; 417/395
(58) Field of Search ..... 123/446, 496, 123/504; 417/395, 394, 388, 390; 92/249

(56) References Cited

U.S. PATENT DOCUMENTS

| | | | | |
|---|---|---|---|---|
| 2,179,354 A | | 11/1939 | Scott | |
| 3,709,639 A | | 1/1973 | Suda et al. | |
| 3,710,771 A | | 1/1973 | Cinquergrani | |
| 3,796,516 A | | 3/1974 | McCormick | |
| 3,800,770 A | | 4/1974 | Baribeau et al. | |
| 3,884,125 A | | 5/1975 | Massie | |
| 3,967,606 A | | 7/1976 | Perry | |
| 3,970,063 A | | 7/1976 | Mayr et al. | |
| 3,987,774 A | | 10/1976 | Waag | |
| 4,087,491 A | | 5/1978 | Chapin | |
| 4,112,901 A | | 9/1978 | Chapin et al. | |
| 4,141,328 A | | 2/1979 | Tipton et al. | |
| 4,208,871 A | | 6/1980 | Riple, Jr. | |
| 4,213,741 A | | 7/1980 | Rogers et al. | |
| 4,253,440 A | | 3/1981 | Sumiyoshi et al. | |
| 4,279,573 A | | 7/1981 | Rychlik et al. | |
| D263,711 S | | 4/1982 | Dean | |
| 4,348,998 A | | 9/1982 | Stumpp | |
| 4,386,888 A | * | 6/1983 | Verley | 417/393 |
| 4,394,331 A | | 7/1983 | Okabe et al. | |
| 4,536,139 A | | 8/1985 | Greco et al. | |
| 4,544,096 A | | 10/1985 | Burnett | |
| 4,781,164 A | | 11/1988 | Seeber et al. | |
| 4,784,322 A | | 11/1988 | Daly | |
| 4,840,155 A | | 6/1989 | Karle | |
| 4,907,949 A | | 3/1990 | Jourde et al. | |
| 4,932,374 A | | 6/1990 | Klomp et al. | |
| 4,936,341 A | | 6/1990 | Mayer | |
| 4,940,035 A | | 7/1990 | Waring | |
| 4,987,878 A | | 1/1991 | Johnson | |
| 5,020,494 A | | 6/1991 | Plohberger et al. | |
| 5,219,274 A | * | 6/1993 | Pawlowski et al. | 417/213 |
| 5,279,504 A | * | 1/1994 | Williams | 417/393 |
| 5,413,076 A | | 5/1995 | Koenigswieser et al. | |
| 5,479,899 A | | 1/1996 | Phelps | |
| 5,647,329 A | | 7/1997 | Bucci et al. | |
| 5,655,501 A | | 8/1997 | Hafner | |
| 5,682,845 A | | 11/1997 | Woody | |
| 5,727,529 A | | 3/1998 | Tuckey | |
| 5,738,075 A | | 4/1998 | Chen et al. | |

FOREIGN PATENT DOCUMENTS

| | | |
|---|---|---|
| WO | WO 87/06307 | 10/1987 |
| WO | WO 89/00243 | 1/1989 |

* cited by examiner

*Primary Examiner*—Henry C. Yuen
*Assistant Examiner*—Mahmoud Gimie
(74) *Attorney, Agent, or Firm*—Michael Best & Friedrich LLP

(57) ABSTRACT

A mechanical fuel pump includes first and second flexible members disposed within a pump body. The first flexible member is deflected in timed sequence with a rotating engine member. Deflection of the second flexible member is limited to select the amount of fuel expelled from the pump for each engine cycle. A stop member is movable in response to movement of an engine governor and throttle to result in increased fuel and air being supplied when the engine encounters a load.

14 Claims, 9 Drawing Sheets

MECHANICAL FUEL INJECTION SYSTEM

This application is a continuation-in-part of U.S. application Ser. No. 09/360,077, filed Jul. 23, 1999.

FIELD OF THE INVENTION

The invention relates to fuel injection systems for internal combustion engines. More particularly, the invention relates to mechanical fuel pumps, injectors, and control systems for small internal combustion engines.

BACKGROUND

It is a goal in the design of internal combustion engines to reduce emissions that may be harmful to the environment. Attempts to achieve this goal have included calibrating the fuel nozzle in a small engine carburetor to deliver just enough fuel as is necessary to run the engine at wide open throttle (WOT), thereby creating a controlled air-to-fuel ratio. Typically, the fuel nozzle delivers amounts of fuel into the carburetor from a fuel source in proportion to the speed of the air flowing through the carburetor throat.

The use of carburetors in small internal combustion engines tends to result in fuel flow rates that are different for various production engines. Another way of reducing harmful emissions is to precisely control the fuel metering from one engine to the next.

Small engines typically include speed governors that position the throttle valve in response to changes in speed of the engine. When the engine is running steadily at full speed, the governor is satisfied with the throttle lever position. When the engine speed decreases due to a sudden increase in load, the volume of air drawn through the carburetor may be reduced before the governor can respond. When the speed governor finally does respond, it may over-shoot the desired throttle setting. Consequently, the amount of fuel drawn through the fuel nozzle is inadequate and the air-to-fuel ratio drops below that which is necessary to support the increased load. For small engines experiencing an increased load, such engine slow-down or speed droop may cause the engine to stumble and stall for want of the correct mixture of air and fuel.

The problem is solved in larger engines (e.g., automobile engines) by incorporating an electronic fuel injection system that is controlled by an electronic control module. Such electronic fuel injection systems are typically expensive and often inappropriate for small engine applications because of the cost sensitivity of the small engine market.

SUMMARY

The present invention provides a mechanical variable pump, fuel injector, and controller for a spark-ignited internal combustion engine. The variable pump includes at least two displaceable members at least partially defining a pump chamber. One displaceable member is movable in response to an actuating force. The volume of the pump chamber decreases and increases cyclically in response to movement of the displaceable members, thereby increasing and decreasing, respectively, the pressure within the pump chamber.

The second displaceable member is moved by a spring and the pressure differential between atmospheric pressure and the pressure in the pump chamber. The movement of this displaceable member is limited by two stop members. One stop member is fixed and the other stop member is adjustable. The position of the adjustable stop member determines the amount of fuel that is pumped in a given cycle.

The adjustable stop member is preferably movable in response to the speed- and throttle-related movement of an engine component. Movement of the second displaceable member is limited as a function of the position of the adjustable stop member. The increase and decrease in pump chamber pressure are therefore dependent at least partially on the position of the adjustable stop member.

Preferably, the two displaceable members are flexible members or diaphragms. Preferably the actuating force is provided by one of a movable engine member (e.g., a cam shaft, cam gear, rotating eccentric bearing, piston, or flywheel), and pressure pulses within the engine.

A biasing member, such as a return spring, may bias the movable member against a cam of the rotating member. The movable member cyclically applies an actuating force to the first displaceable member to move the first displaceable member from a rest position in a positive direction in response to cam rotation or the movement of another engine component. The return spring biases the movable member in a negative direction, opposite the positive direction, to the rest position for each rotation of the cam or movement of another engine component. Alternatively, the movable member may be biased by another rotating engine component other than a cam. It could also be biased by an eccentric bearing on a shaft.

Preferably the adjustable stop member engages the second flexible member to limit its deflection in the negative direction. Preferably, the variable pump includes a second stop member that limits deflection of the second flexible member in the positive direction. A return spring may be used to bias the second flexible member toward the positive direction.

Preferably, the pump chamber is substantially airtight except for an inlet valve and an outlet passage to the fuel injector. The inlet valve is a one-way valve that only allows fluid flow into the pump chamber from a fuel source. The outlet passage allows fluid flow from the pump chamber to the fuel injector.

The fuel is injected into a mixing chamber in the air intake passageway, an air intake manifold, or other chamber through which air is introduced into the combustion chamber during the intake stroke. The inlet valve and fuel injector are each characterized by a "cracking pressure," at which the valve or fuel injector opens.

The second flexible member also deflects, in response to the cyclical deflection of the first flexible member, to the extent permitted by the adjustable stop member and the optional second stop member. Continued deflection of the first flexible member after the second flexible member is stopped results in a decrease or increase in the pump chamber volume and a resulting increase or decrease in pressure in the pump chamber. When the pressure in the pump chamber drops to the cracking pressure of the inlet valve, fuel is draw into the pump chamber. When the pressure reaches the cracking pressure of the fuel injector, fuel is expelled from the pump chamber and through the fuel injector.

The fuel injector includes a fuel nozzle in fluid flow communication between the pump and the mixing chamber. The fuel nozzle is biased with a return spring or other biasing member toward a closed position so that fuel is not allowed to flow into the mixing chamber except when the pressure is high enough. Preferably, the fuel expelled from the pump chamber provides enough pressure to open the fuel nozzle so that fuel is admitted into the mixing chamber. Preferably, the fuel injector includes a flexible member, such as a diaphragm, that deflects in response to fuel pressure to permit fuel to spray into the mixing chamber.

The change in pump chamber volume is dependent on the positions of the stop members. Therefore, the amount of fuel drawn into and expelled from the pump chamber is also dependent on the positions of the stop members. Preferably, the amount of deflection permitted by the second stop member is fixed. Preferably, the engine includes an automatic mechanical control system, such as a speed governor, that senses the speed of the engine and throttle position, and adjusts the position of the adjustable stop member accordingly. When the engine is running at a normal operating speed and load, the control system may position the adjustable stop member so that just enough fuel is pumped to keep the engine running. When the engine speed droops due to an increased load, the control system may position the adjustable stop member so that increased amounts of fuel are pumped and the engine does not stumble and/or stall.

DETAILED DESCRIPTION

Figure 1:
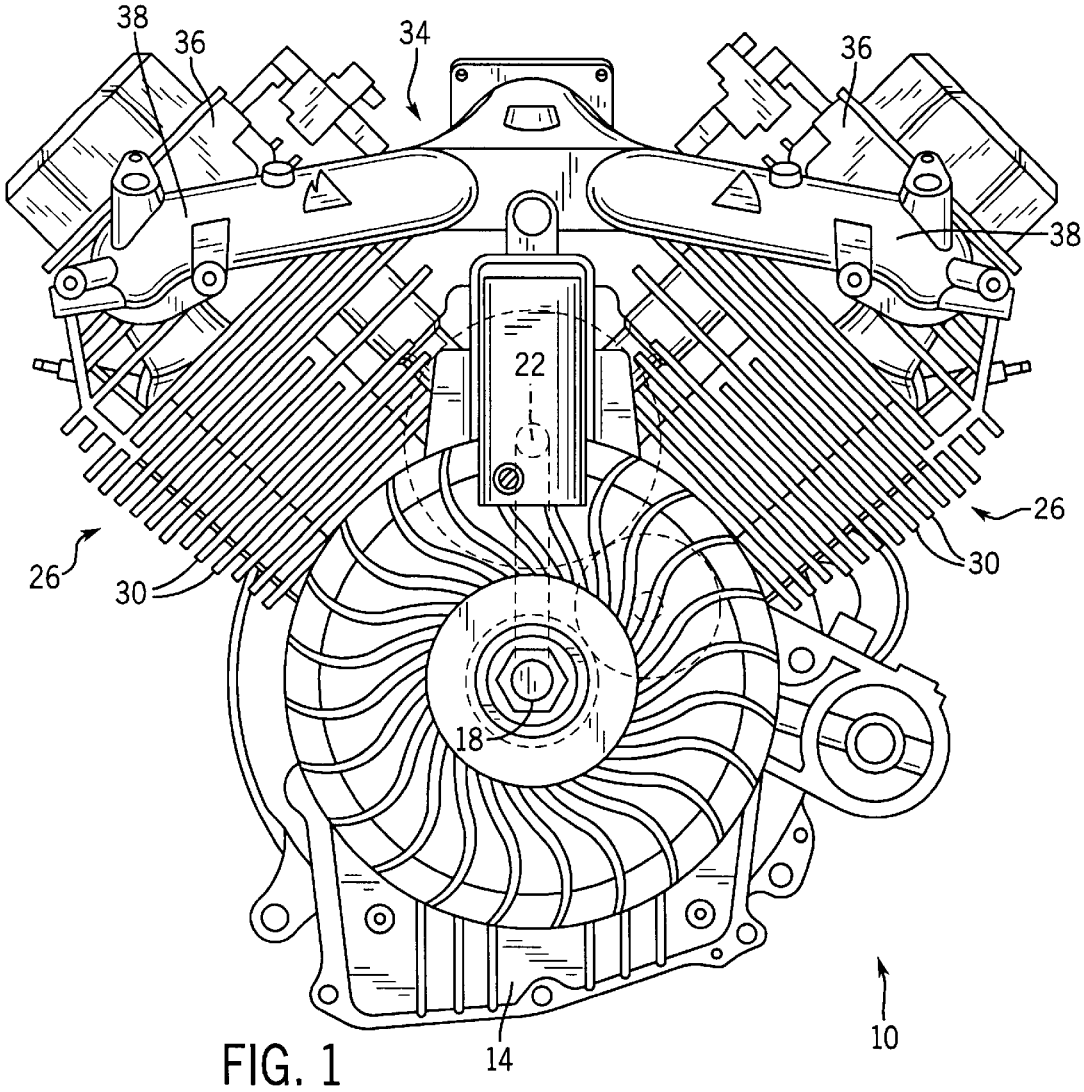
FIG. 1 is an end elevational view of an internal combustion engine embodying the present invention.
Figure 2:
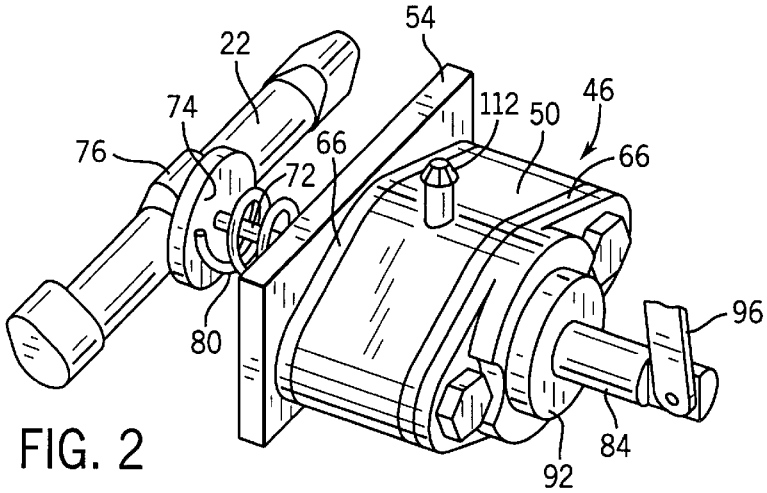
FIG. 2 is a perspective view of the variable pump according to the present invention.
Figure 3:
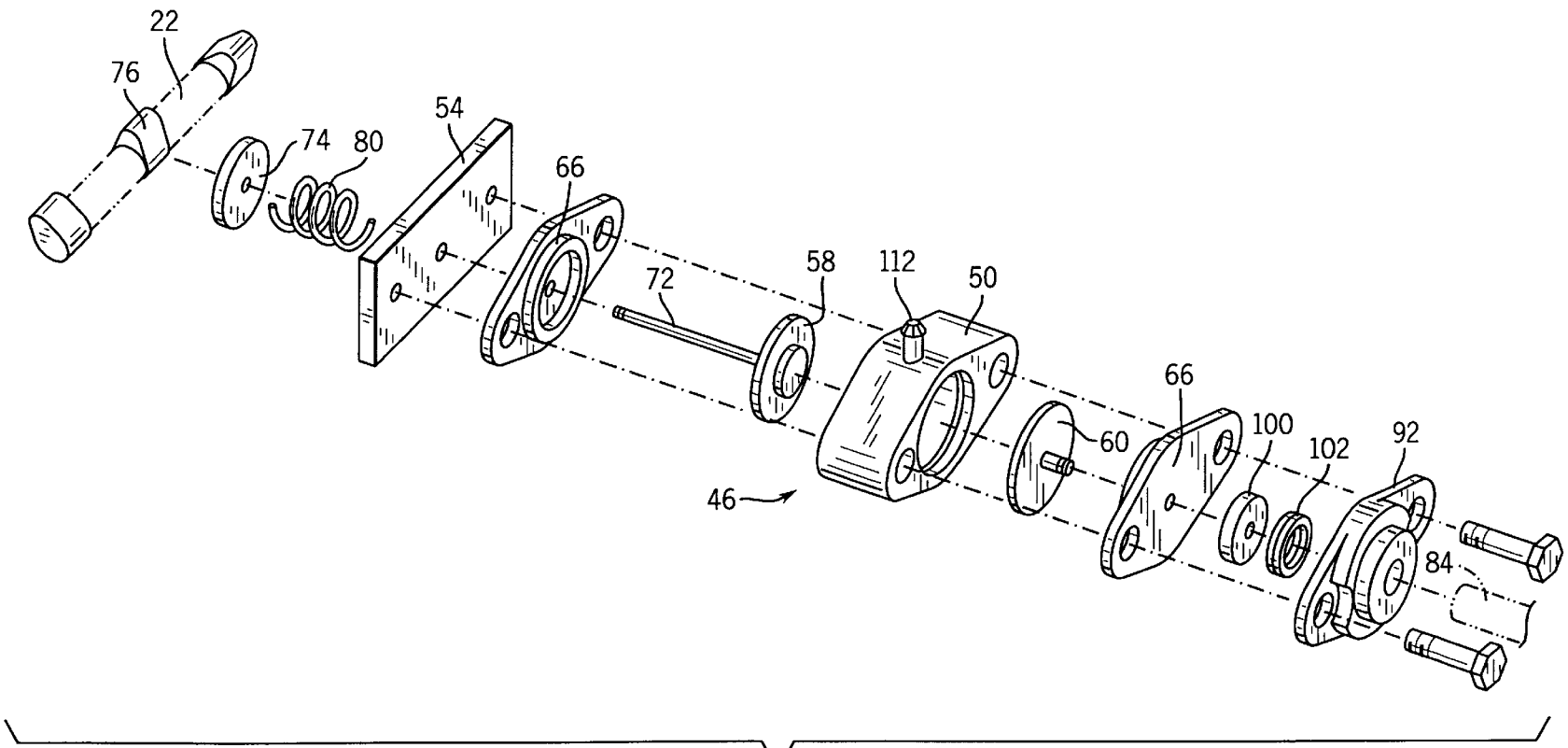
FIG. 3 is an exploded perspective view of the variable pump.

FIG. 1 illustrates a spark-plug ignition internal combustion engine 10. The engine 10 includes a crankcase 14, a crankshaft 18, a cam shaft 22, a pair of cylinders 26 having external cooling fins 30, and an air intake manifold 34 for supplying air to the cylinders 26. A combustion chamber is defined in the head portion 36 of each cylinder 26. A fuel and air mixing chamber portion 38 (shown also in phantom in FIG. 5) of the air intake manifold 34 communicates with the combustion chamber through an intake valve. Air is drawn from the surrounding atmosphere through the air intake manifold 34 and the intake valves, and into the combustion chambers during an intake stroke.

Figure 4:
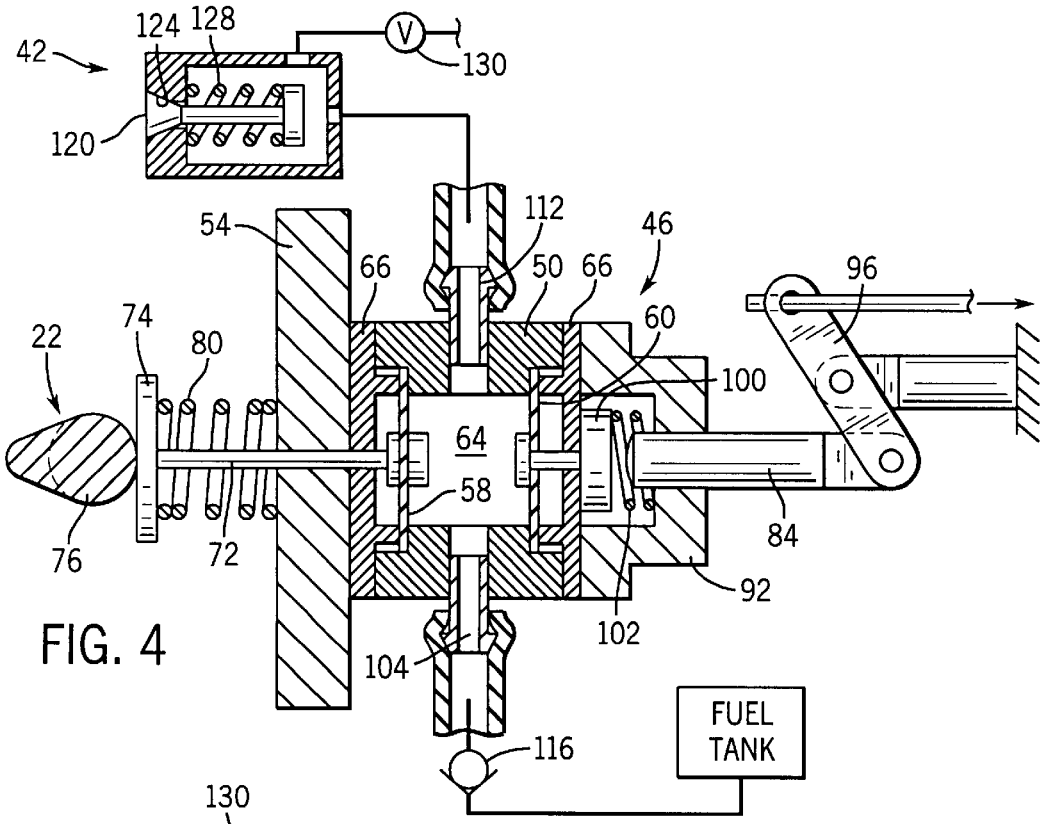
FIG. 4 is a cross-sectional view of the variable pump at rest.
Figure 5:
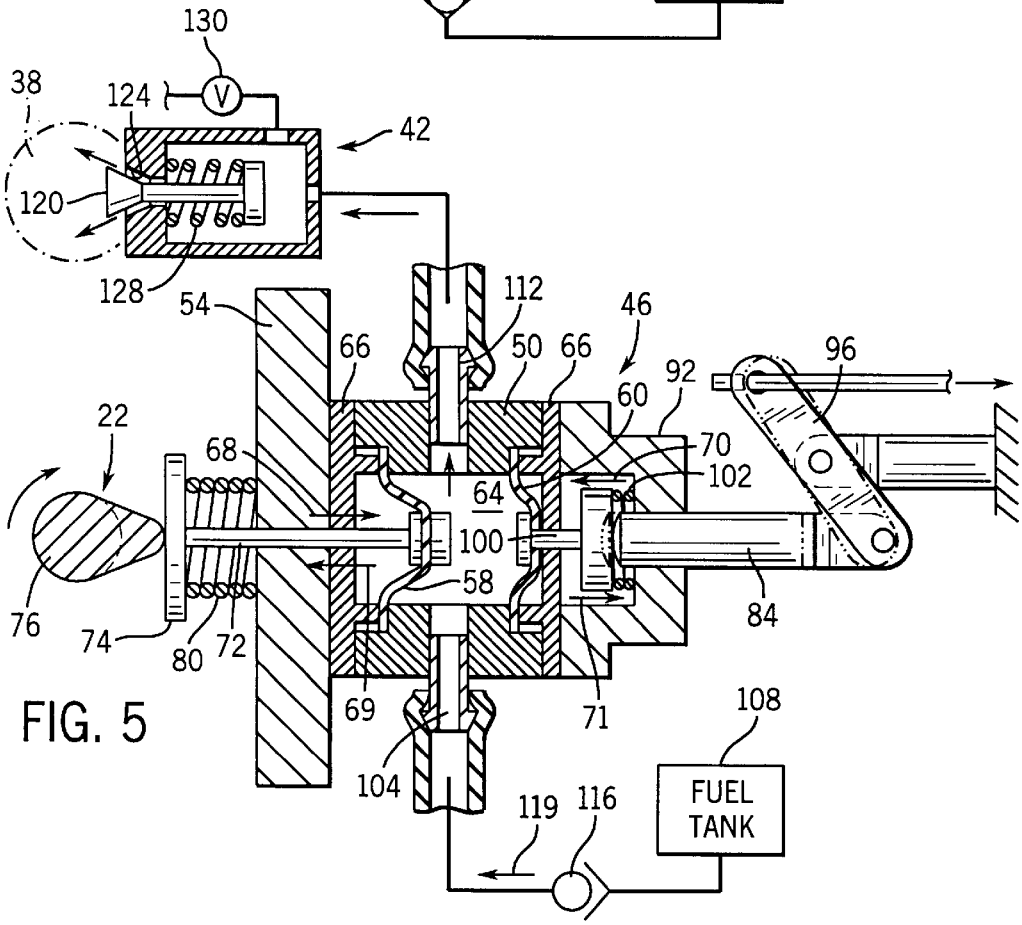
FIG. 5 is a cross-sectional view of the variable pump at peak displacement.
Figure 6:
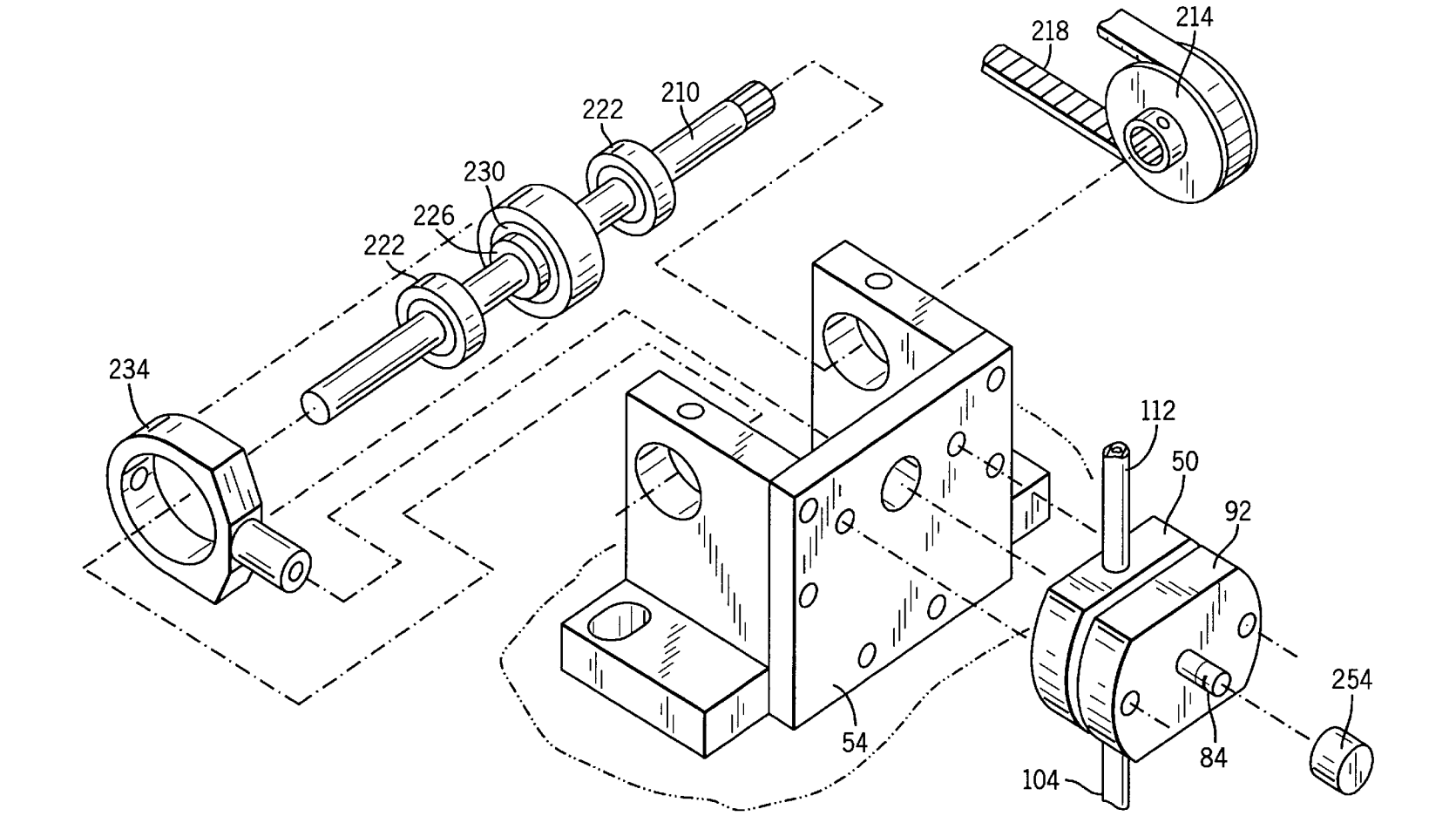
FIG. 6 is an exploded view of an alternative embodiment of the pump.

Referring to FIGS. 4 and 5, a fuel injector nozzle 42 provides fuel that mixes with the air in the mixing chamber 38. The fuel and air mixture passes through the intake valves into the combustion chambers, where the mixture is ignited by a spark plug to cause an explosion that drives the crankshaft 18. Although a two-cylinder, four stroke V-type engine 10 is illustrated, the invention may be embodied in any spark-ignited internal combustion engine.

FIGS. 2–5 illustrate a fuel pump 46 for providing fuel to the mixing chamber 38. The fuel pump 46 generally includes a pump body 50 mounted on a portion 54 (e.g., the crankcase 14) of the engine 10. Within the pump body 50 are first and second displaceable members, which in the illustrated embodiment are first and second flexible members 58, 60 (e.g., diaphragms), that at least partially define a pump chamber 64.

The first and second flexible members 58, 60 are sandwiched between the central portion of the pump body 50 and the end caps 66 of the pump body 50. The first and second flexible members 58, 60 may be secured within the pump body 50 by any suitable means, however.

The first and second flexible members 58, 60 are deflectable in positive and negative directions. The positive and negative directions associated with the first flexible member 58 are indicated in FIG. 5 with the reference numerals 68 and 69, respectively. The positive and negative directions associated with the second flexible member 60 are indicated with the reference numerals 70 and 71. As used herein, "positive direction," when referring to the deflection of the first and/or second member 58, 60, means a direction tending to decrease the volume and increase the pressure in the pump chamber 64. "Negative direction," as used herein, means a direction tending to increase the volume and decrease the pressure in the pump chamber 64.

The first flexible member 58 is engaged by or interconnected with a movable member 72. The movable member 72 extends from the first flexible member 58 to an end 74 engaging a cam 76 on the cam shaft 22. A biasing member (e.g., return spring 80) biases the movable member 72 against the cam 76 so that the movable member 72 acts as a cam follower. The movable member 72 reciprocates in response to rotation of the cam 76, and provides an actuating force that deflects the first flexible member 58 from the minimum or rest position is shown in FIG. 4 in the positive direction 68 to the maximum position shown in FIG. 5. The return spring 80 urges the movable member 72 in the negative direction 69 back to the minimum position shown in FIG. 4 as the cam 76 completes each rotation.

It should be noted that the movable member 72 is not limited to the specific configuration shown. Also, the movable member 72 may be actuated by any means for cyclically deflecting the first flexible member 58 in timed sequence with the rotation of a rotatable member of the engine 10. For example, the movable member 72 may be actuated by the crankshaft 18; a cam gear; a shaft that is distinct from the cam shaft 22, but that has a cam; the engine flywheel; an engine output shaft; a piston; or any other member that moves as a function of engine speed. Also, the actuating force may be provided in any suitable form, such as pressure pulses within the engine (e.g., within the crankcase 14) that correspond to the cyclical movement of an engine component (e.g., the piston). The pressure pulses may act directly on one of the flexible members 58, 60, or through a movable member engaging one of the flexible members 58, 60.

The movable member 72 may be moved cyclically from the minimum position to the maximum position, and back to the minimum position for each rotation of the crankshaft 18. Alternatively, the movable member 72 may be moved through one cycle for every two rotations of the crankshaft 18.

A first adjustable stop member 84 is disposed in spaced relation to the second flexible member 60, and is adapted to selectively limit movement (e.g., deflection) of the second flexible member 60 in the negative direction 71 (FIG. 5), which is illustrated as being the same as the positive direction 68 of the first flexible member 58. The illustrated first stop member 84 is slidable within a guide member 92, and actuated by a lever assembly 96 connected with an engine component whose movement is a function of engine speed (e.g., a speed governor or flywheel).

Alternatively, the first stop member 84 may be threaded into the guide member 92 such that relative rotation between the guide member 92 and the first stop member 84 will cause the first stop member 84 to move toward or away from the second flexible member 60. In that case, the guide member 92 or the first stop member 84 may be rotated by a linkage interconnected with a speed-responsive component of the engine 10. Alternatively, the first stop member 84 may include any components that move toward or away from the second flexible member 60 in response to changes in engine speed.

A second stop member 100 engages or is interconnected with the second flexible member 60. The illustrated second stop member 100 is generally barbell-shaped. The second stop member 100 limits movement of the second flexible member 60 in the positive direction 70 when the second stop member 100 abuts the end cap 66, as shown in FIG. 4. The second stop member 100 also abuts the first stop member 84 to limit movement of the second flexible member 60 in the negative direction 71, as shown in FIG. 5. An optional biasing member (e.g., coil return spring 102) may be used to bias the second stop member 100 and the second flexible member 60 in the positive direction 70.

It is understood that the positive and negative directions associated with the respective first and second flexible members 58, 60 are not required to be parallel to each other. For example, the flexible members 58, 60 may be disposed other than directly opposite each other (i.e., other than as shown in the drawings), in which case the positive and negative directions associated with the first flexible member 58 would not necessarily be parallel to the positive and negative directions associated with the second flexible member 60.

The movable member 72 and the second stop member 100 are preferably fixedly attached, respectively, to the first and second flexible members 58, 60 with adhesive, by integral forming, with nuts sandwiching the flexible member 58 or 60, or any other suitable means for fixedly attaching.

Also included in the pump 46 are an inlet 104 in fluid flow communication between the pump chamber 64 and a source of fuel (e.g., a fuel tank 108), and an outlet 112 in fluid flow communication between the pump chamber 64 and the fuel nozzle 42. The inlet 104 has associated therewith a one-way valve 116 having a "cracking pressure," and permitting flow of fuel substantially only in the direction indicated by arrow 119 (FIG. 5). The inlet one-way valve 116 opens in response to negative pressure in the pump chamber 64.

The fuel nozzle 42 includes a valve head 120 that seats against an opening 124, and a return spring 128. In this regard, the fuel nozzle 42 also has a "cracking pressure" at which the nozzle opens and permits fuel to escape. The fuel nozzle 42 is disposed near the mixing chamber 38, and, when the cracking pressure is reached, introduces a spray of fuel to be mixed with air prior to the fuel and air mixture entering the combustion chamber. The fuel nozzle 42 has associated therewith a valve 130 for purging air from the system.

In operation, fuel enters the pump chamber 64 through the inlet valve 116 and inlet 104, and is disposed between the first and second flexible members 58, 60. The cam shaft 22 rotates in timed sequence with the crankshaft 18 of the engine 10, causing the movable member 72 and the first flexible member 58 to move in the positive direction 68. The second flexible member 60 deflects in the negative direction 71 in response to deflection of the first flexible member 58 in the positive direction 68 until the first and second stop members 84, 100 abut each other.

Continued movement of the first flexible member 58 in the positive direction 68 after the second flexible member 60 has stopped moving, results in a reduction in the volume, and increased pressure in the pump chamber 64. When the pressure reaches the preset threshold level, the fuel nozzle 42 opens, permitting the pressurized fuel to escape the pump chamber 64 through the outlet 112.

The pressurized fuel causes the valve head 120 to unseat from the opening 124 against the biasing force of the return spring 128, and the fuel is sprayed into the mixing chamber 38 in the air intake manifold 34. The fuel is mixed with incoming air in the mixing chamber 38, and the mixture is drawn into the combustion chamber when the intake valve opens.

The amount of fuel expelled from the pump chamber 64 is dependent on the amount of displacement of the first flexible member 58 after the second flexible member 60 has been stopped. Thus, less fuel is expelled from the pump chamber 64 when the first stop member 84 is disposed in the position shown in solid lines in FIG. 5 than when the first stop member 84 is disposed in the position shown in phantom in FIG. 5.

After the movable member 72 has reached the maximum position (shown in FIG. 5), continued rotation of the cam shaft 22, and the biasing force of the return spring 80, cause the movable member 72 and first flexible member 58 to move in the negative direction 69. The pressure drops and the fuel nozzle 42 closes.

The second flexible member 60 moves in the positive direction 70 as the first flexible member 58 moves in the negative direction 69 until movement of the second flexible member 60 is stopped by the second stop member 100 as shown in FIG. 4. The spring 102 therefore only has to provide enough biasing force to move the second stop member 100 and second flexible member 60 in the positive direction 70 when there is negative pressure in the pump chamber 64. Continued movement of the first flexible member 58 in the negative direction 69 after the second flexible member 60 has been stopped creates a vacuum or negative pressure condition in the pump chamber 64. The inlet one-way valve 116 opens in response to such negative pressure, fuel is drawn into the pump chamber 64 from the fuel tank 108, and the process repeats itself.

When the engine 10 encounters a heavy load, such as tall grass in the case of a lawnmower, the engine speed droops and the speed-responsive member of the engine 10 moves. The linkage 96 moves in response to movement of the speed-responsive member. The linkage 96 slides, rotates, or otherwise moves the first stop member 84, causing it to advance to the left (as shown in phantom in FIG. 5) in response to such a speed droop. The result is more fuel and more air being supplied to the mixing chamber 38, and more output power for the engine 10 to drive the increased load.

An alternative embodiment of the pump assembly is illustrated in FIGS. 6–9. Like features in this embodiment and that illustrated in FIGS. 2–5 are identified with like numerals.

The actuating mechanism for this embodiment includes a shaft 210 that may be a rotating shaft of the engine 10 (e.g., the cam shaft 22 or crankshaft 18), or may be driven by a rotating engine shaft with suitable means (e.g., a pulley 214 and belt 218). The shaft 210 is supported for rotation by suitable bearings 222. Mounted on the shaft 210, between the bearings 222, is an eccentric 226. The eccentric 226 includes a round member having an off-center aperture through which the shaft 210 extends. A driver bearing 230 is press fit around the eccentric 226, and a driver 234 is press fit around the bearing 230 and secured thereto with a set screw 238.

The movable member 72 includes a threaded pin 240 that is threaded into the driver 234, and a connector 242. The connector 242 is attached to a portion of the first flexible member 58. Thus, the driver 234 is coupled to the first flexible member 58 through the pin 240 and the connector 242.

The eccentric 226 rotates with the shaft 210 and causes the driver 234 to reciprocate back and forth to drive the first flexible member 58 in the positive and negative directions 68, 69. Some adjustment may be made to the displacement of the first flexible member 58 by providing a longer or shorter threaded pin 240, and by threading the pin 240 more or less deeply into the driver 234 and connector 242.

Figure 7:
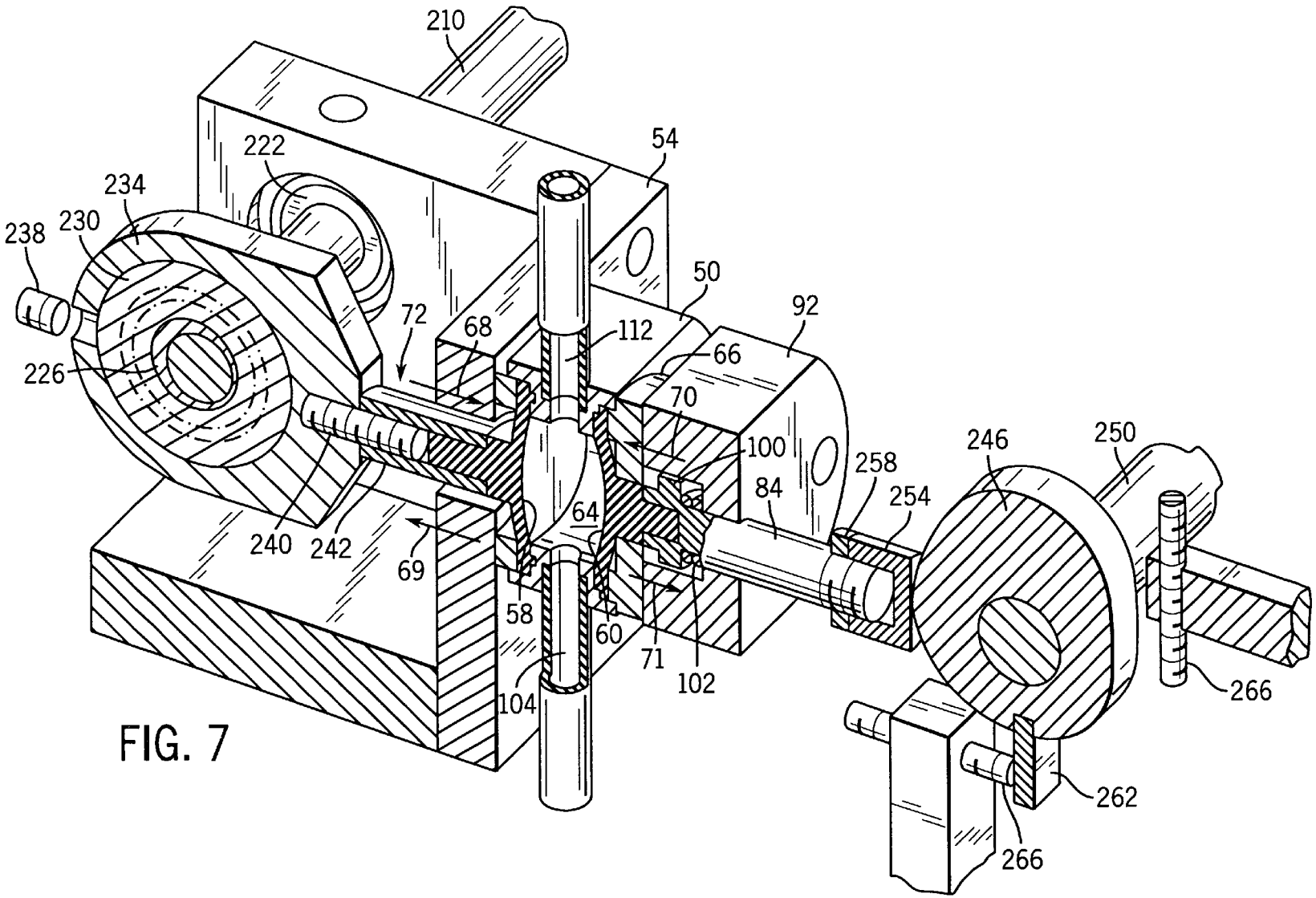
FIG. 7 is a perspective cross-sectional view of the alternative embodiment.
Figure 9:
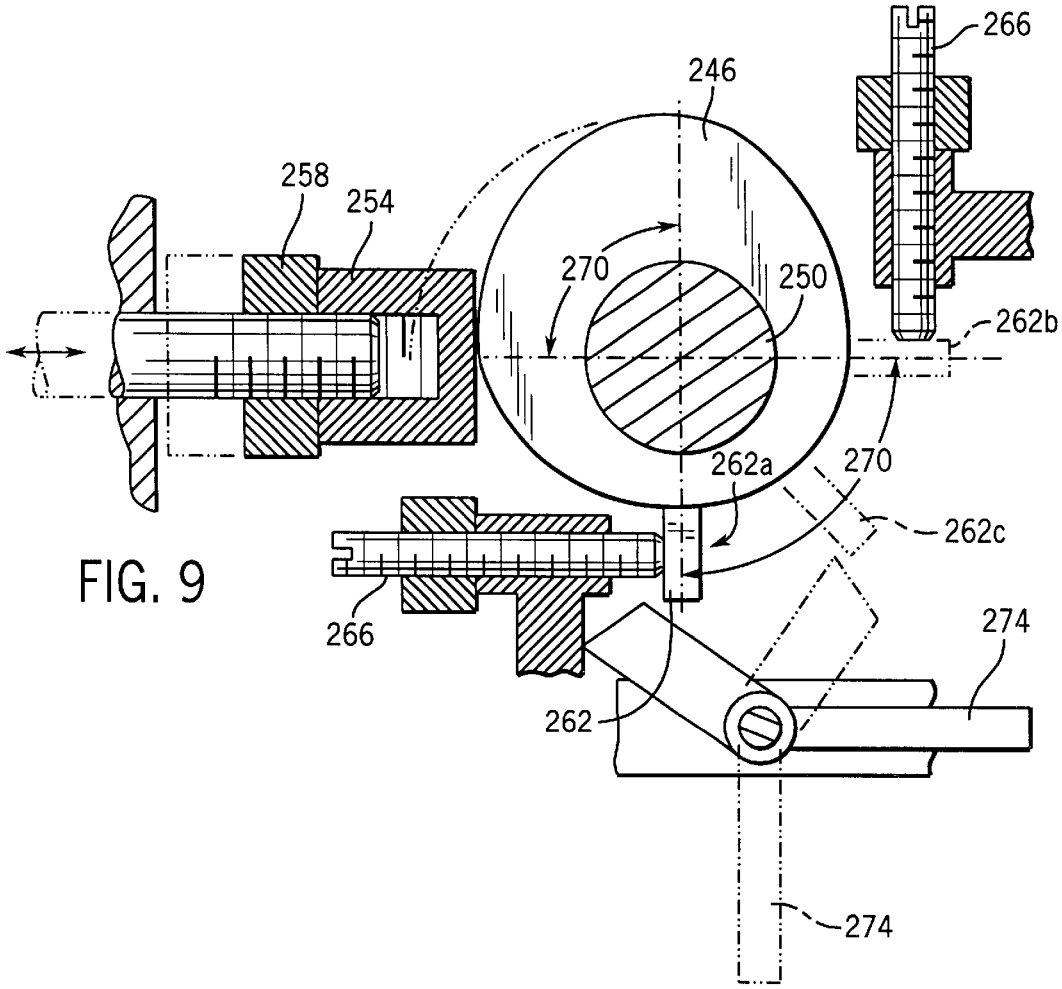
FIG. 9 is a cross-sectional view of an alternative control system.

The adjuster or control mechanism in this embodiment, shown in FIGS. 7 and 9, includes a cam 246 mounted on a rotatable shaft 250. The shaft 250 may be coupled with a speed governor or other speed responsive element of the engine 10. When the engine speed increases or decreases, the shaft 250 is rotated in one direction or the other. The adjustable stop member 84 is a threaded elongated member having a cap 254 and locking nut 258 threaded onto its end. The second stop member 100 in this embodiment is provided in the guide member 92, and is fixed to the adjustable stop 84 and the second flexible member 60. The return spring 102 may also be used in this embodiment to assist movement of the second flexible member 60 in the positive direction 70 when there is negative pressure in the pump chamber 64.

As with the embodiment illustrated in FIGS. 4 and 5, the adjustable stop member 84 limits deflection of the second flexible member 60 in the negative direction 71, and the second stop member 100 limits deflection of the second flexible member 60 in the positive direction 70. In this regard, the deflection of the second flexible member 60 in the embodiment of FIGS. 2–5, and that of FIGS. 6–9, is limited as a function of the positions of the first and second stop members 84, 100.

Referring to FIG. 9, a protrusion 262 extends from the cam 246. A pair of adjustable members 266 are provided near the cam 246. The adjustable members 266 abut the protrusion 262 at the positions identified as 262*a* and 262*b* (shown in phantom), and therefore limit the rotation of the cam 246 to a desired range 270 (e.g., about 90°). When the cam 246 is in the position shown in FIG. 9, maximum deflection of the second flexible member 60 in the negative direction 71 is permitted. When the cam 246 is rotated through the full range 270 to the position shown in phantom in FIG. 9 (i.e., when the protrusion 262 is in the position 262*b*), the second flexible member 60 is limited to minimal deflection in the negative direction 71. Thus, the maximum amount of fuel will be expelled from the pump chamber 64 when the cam 246 is positioned as shown in phantom in FIG. 9 and the protrusion 262 is in the position 262*b*.

To provide enrichment for starting purposes, a manually-operated lever 274 will temporarily change where the cam 246 is set at idle, thereby providing increased fuel flow. The lever 274 is normally positioned as shown in solid lines in FIG. 9. During startup, the lever 274 may be moved to the position shown in phantom in FIG. 9, which will move the protrusion 262 to the position labeled 262*c*, and rotate the cam 246 counterclockwise as seen in the drawing. This will limit movement of the second flexible member 60 in the negative direction 71 enough to provide sufficient extra fuel for starting the engine 10.

Figure 8:
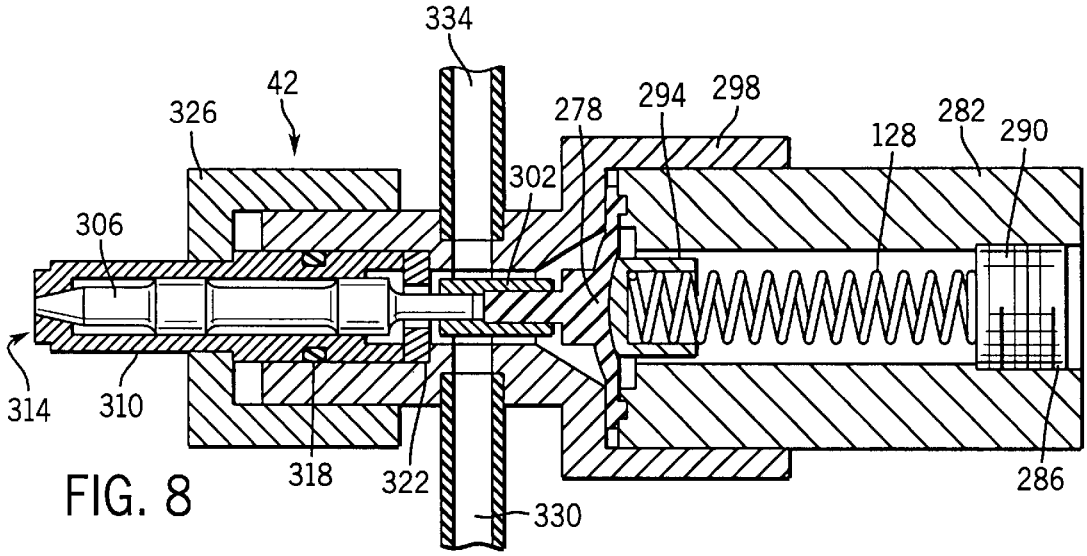
FIG. 8 is a cross-sectional view of the fuel injector.

FIG. 8 illustrates the fuel nozzle or injector 42 for this embodiment. As with the first embodiment, the fuel injector 42 includes a return spring 128. The return spring 128 biases a diaphragm 278 to the left as seen in FIG. 8. The return spring 128 is housed in a diaphragm cap 282, and the amount of bias is controlled by a set screw 286 and locking screw 290. A spring cup 294 is provided at the end of the spring 128 remote from the set screw 286, and abuts the diaphragm 278.

The diaphragm cap 282 is threaded or otherwise secured within a diaphragm housing 298. The diaphragm 278 is sandwiched between the diaphragm cap 282 and the diaphragm housing 298. A connector 302 couples the diaphragm 278 to a needle or pintle 306. The needle 306 extends into an injector body 310 and seats against an outlet end 314 of the injector body 310 to create an airtight seal. An O-ring 318 provides an airtight seal between the injector body 310 and the diaphragm housing 298. A pintle stop 322 is disposed at one end of the injector body, and limits movement of the needle 306 to the right as shown. A body fastener 326 is threaded or otherwise secured over the injector body 310 and to the diaphragm housing 298.

A fuel inlet 330 and a vent 334 communicate with the inside of the diaphragm housing 298. The vent 334 is associated with the valve 130 shown in FIGS. 4 and 5. The valve 130 is normally closed, but may be manually opened to vent air from the system. The fuel inlet 330 is in communication with the outlet 112 of the pump 46.

The return spring 128 biases the diaphragm 278 and needle 306 to the left (as seen in FIG. 8) such that the needle 306 seats against the outlet end 314 of the injector body 310. The fuel pump 46 cyclically forces fuel into the diaphragm housing 298. The fuel pressure acts on the diaphragm 278 against the biasing force of the return spring 128. When the fuel pressure has risen high enough to deflect the diaphragm 278 and return spring 128 to the right, the needle 306 unseats, and the fuel is expelled into the mixing chamber 38. The return spring 128 then moves the diaphragm 278 and needle 306 to the left to again seat the needle 306 against the outlet end 314 of the injector body 310.

Figure 10:
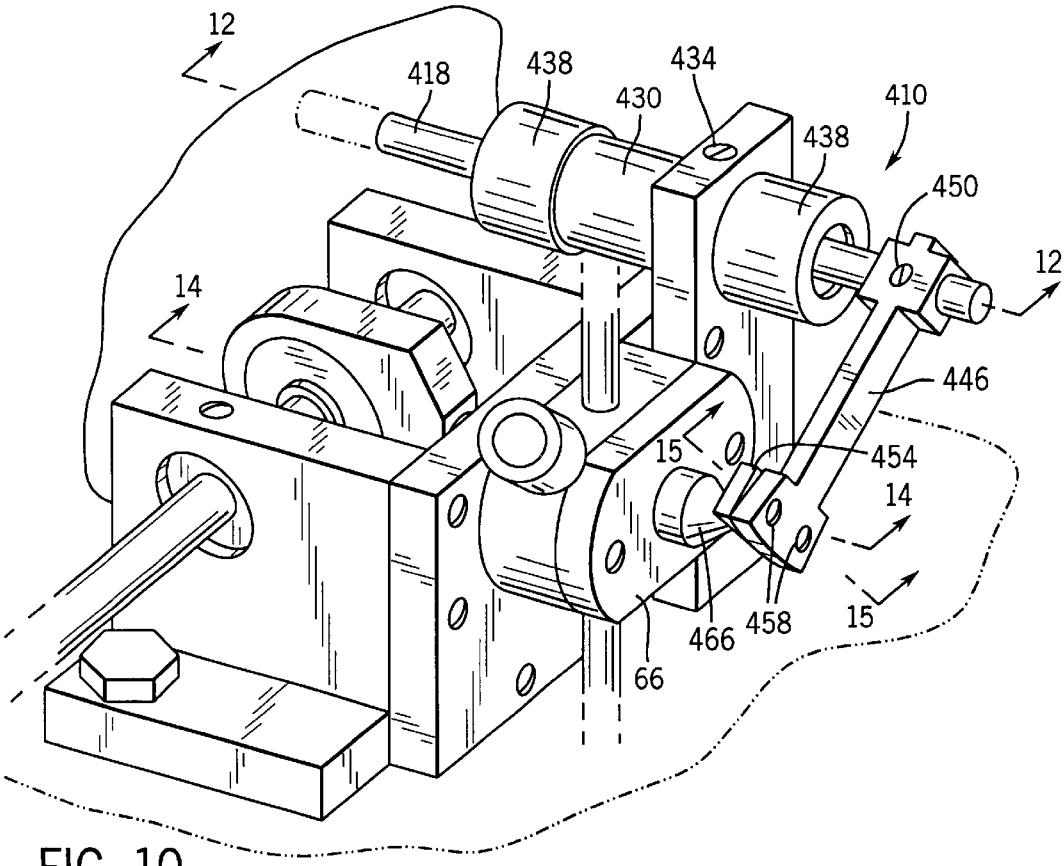
FIG. 10 is a perspective view of another alternative control system.
Figure 11:
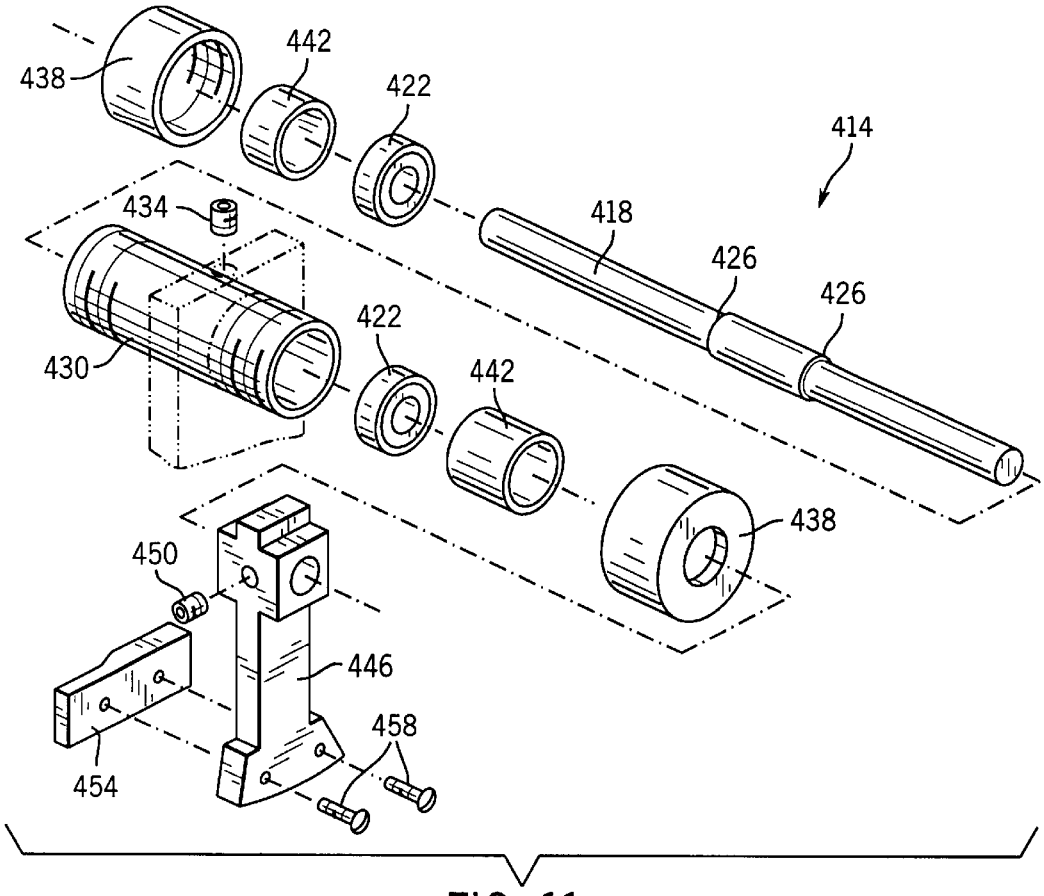
FIG. 11 is an exploded view of the control shaft assembly of the control system of FIG. 10.
Figure 12:
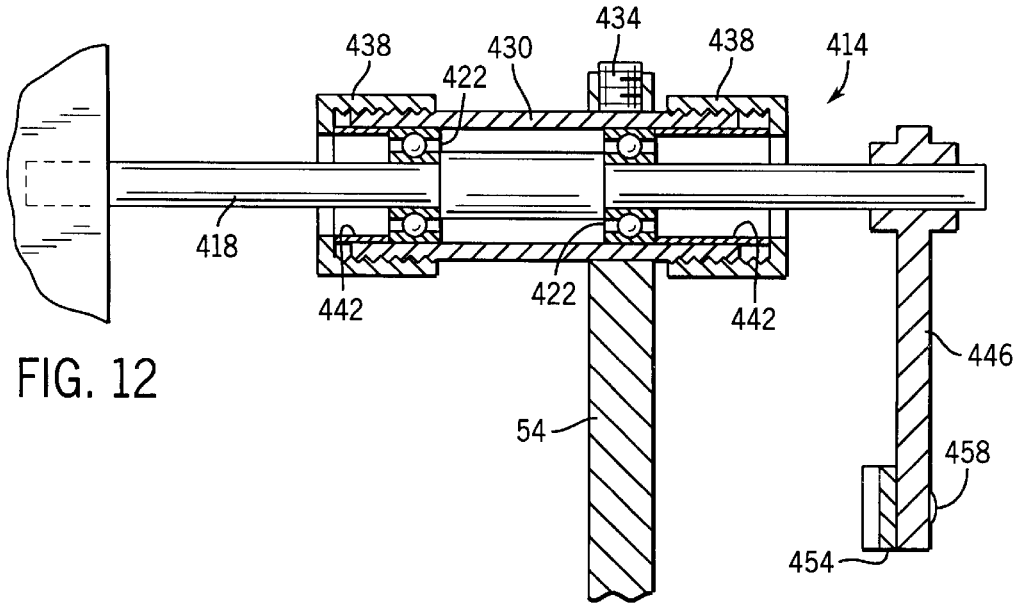
FIG. 12 is a cross-sectional view taken along line 12—12 in FIG. 10.

An alternative control system 410 is illustrated in FIGS. 10–15. Where elements of the control system 410 are the same as previously described, the same reference numerals are used. As seen in FIGS. 10–12, the control system 410 includes a control shaft assembly 414. The control shaft assembly 414 includes a control shaft 418 that is coupled to the speed governor of the engine 10. The control shaft 418 is supported by bearings 422 having inner and outer races. Preferably, the bearings 422 are press-fit onto the control shaft 418. The control shaft 418 includes a portion of increased diameter that provides a pair of spaced shoulders 426. The inner races of the bearings 422 abut the shoulders 426.

The bearings 422 are housed in a bearing housing 430 that is supported by a portion of the engine housing 54, and that is secured to the engine housing 54 with a set screw 434. A pair of bearing caps 438 are threaded on the ends of the bearing housing 430, and a pair of bearing spacers 442 are sandwiched between the outer races of the bearings 422 and the bearing end caps 438.

A control arm 446 is slid onto the control shaft 418, and is secured to the control shaft 418 with a set screw 450. The control arm 446 thus rotates with the control shaft 418. A profile member 454 is secured to the control arm 446 with a pair of fasteners 458. The profile member 454 includes a profile surface, the significance of which is discussed below.

Figure 15:
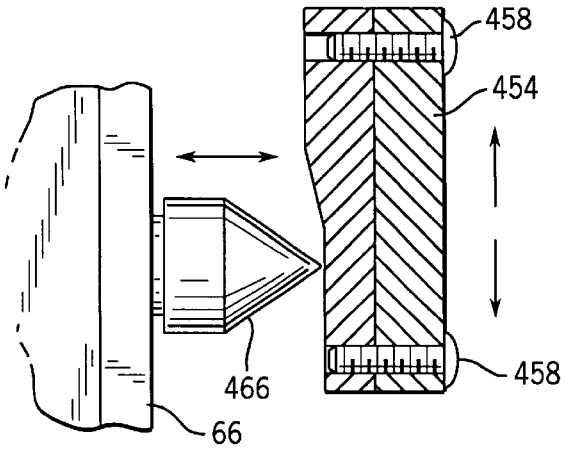
FIG. 15 is an end view of the system of FIG. 10, taken along line 15—15 in FIG. 10.
Figure 13:
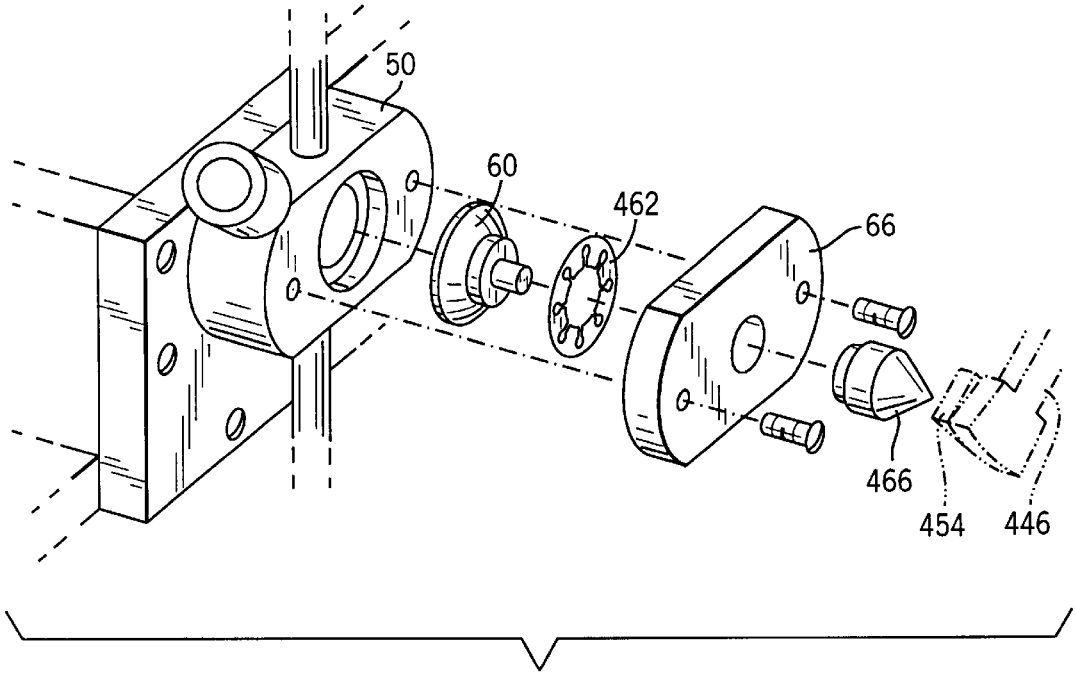
FIG. 13 is an exploded view of selected components of the control system of FIG. 10.
Figure 14:
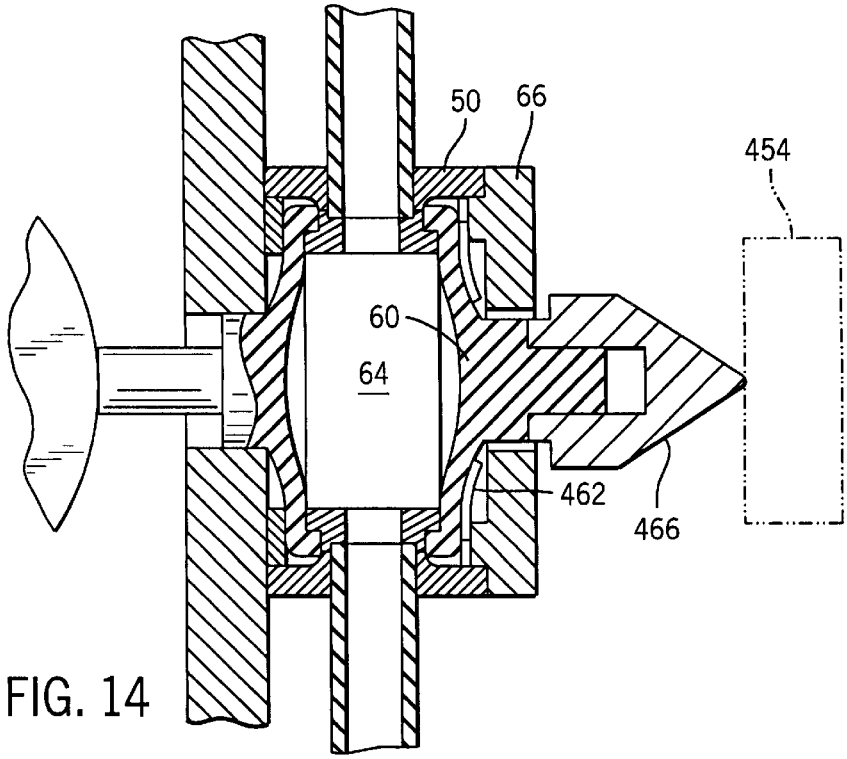
FIG. 14 is a cross-sectional view taken along line 14—14 in FIG. 10.

FIGS. 13–15 illustrate further aspects of the control system 410. A diaphragm spring 462 is secured with the control diaphragm 60 between the pump body end cap 66 and the pump body 50. The diaphragm spring 462 biases the control diaphragm 60 toward a rest position. A space is provided around the periphery of the control diaphragm 60 to permit radial expansion of the diaphragm 60 due to compression of the control diaphragm material. A profile follower 466 is secured to the control diaphragm 60, and includes a polished end point that contacts the profile surface of the profile member 454. A guide member 92 substantially as illustrated in FIG. 7 may be used to guide movement of the profile follower 466. Depending on the position of the control arm 446, the profile surface permits more or less deflection of the control diaphragm material 60.

In operation, the control shaft 418 is rotated in response to movement of the engine speed governor. Rotation of the control shaft 418 causes rotation of the control arm 446 and movement of the profile member 454 in the directions indicated in FIG. 15. As fuel is expelled from the pump chamber 64, the control diaphragm 60 is deflected to the right as seen in FIG. 14, causing the profile follower 466 to move toward the profile member 454. The shape of the profile surface is selected to permit the appropriate amount of fuel to be injected into the mixing chamber 38 based on the position of the governor. Thus, the amount of fuel provided to the mixing chamber 64 is a function of the position of the speed governor.

Although particular embodiments of the present invention have been shown and described, other alternative embodiments will be apparent to those skilled in the art and are within the intended scope of the present invention. Thus, the present invention is to be limited only by the following claims.

What is claimed is:

1. A variable pump for use in an internal combustion engine, the pump comprising:

a pump body;

first and second displaceable members interconnected with said pump body, and movable in response to an actuating force; and an adjustable stop member movable with respect to said second displaceable member;

whereby displacement of said second displaceable member in a negative direction is limited as a function of the position of said adjustable stop member;

wherein said first and second displaceable members include first and second flexible members, respectively, and said first flexible member is displaceable in response to said actuating force; and wherein said first and second flexible members at least partially define a pump chamber within said pump body, and wherein pressure in said pump chamber is increased in response to the deflection of said first flexible member and the limitation of deflection of said second flexible member.

2. The pump of claim 1, wherein said actuating force is provided by a movable member engageable with said first displaceable member.

3. The pump of claim 2, wherein said movable member includes a cam follower movable in response to rotation of a cam.

4. The pump of claim 1, wherein said actuating force is provided by an eccentric bearing on a rotating shaft.

5. The pump of claim 1, further comprising a fuel injector, said fuel injector opening in response to increased pressure in said pump body to permit fluid flow from said pump body.

6. The pump of claim 5, wherein said fuel injector includes a flexible member deflecting in response to increased pressure in said pump body.

7. The pump of claim 1, further comprising a second stop member, wherein displacement of said second displaceable member in a positive direction is limited as a function of the position of said second stop member.

8. The pump of claim 1, further comprising a one-way valve that opens in response to negative pressure in said pump body, said one-way valve adapted to allow fluid flow from a fuel source of the engine into said pump body.

9. The pump of claim 1, wherein said adjustable stop member includes a threaded member, said adjustable stop member being movable by rotation of said threaded member.

10. The pump of claim 1, wherein said adjustable stop member is adjusted in response to rotation of a cam.

11. A variable pump for use in an internal combustion engine, the pump comprising:

a pump body;

first and second displaceable members interconnected with said pump body, and movable in response to an actuating force;

an adjustable stop member movable with respect to said second displaceable member;

a control arm adapted to move in response to movement of a speed governor of the engine; and a profile surface interconnected with said control arm and movable with said control arm, said profile surface being abutted by said adjustable stop member;

whereby displacement of said second displaceable member in a negative direction is limited as a function of the position of said control arm.

12. The pump of claim 11, further comprising a control shaft interconnected between said control arm and the speed governor of the engine, said control shaft rotating in response to movement of the speed governor, and said control arm rotating in response to rotation of said control shaft.

13. The pump of claim 11, wherein said profile surface is substantially wedge-shaped.

14. The pump of claim 11, further comprising a diaphragm spring biasing said second diaphragm toward a rest position.

* * * * *